US005261248A

United States Patent [19]

Willis et al.

[11] Patent Number: 5,261,248

[45] Date of Patent: Nov. 16, 1993

[54] FILL CUP SLEEVE FOR A RECOVERABLE DOMESTIC ICEMAKER

[75] Inventors: James L. Willis, Ft. Smith; Tariq A. Diab, Van Buren, both of Ark.

[73] Assignee: Whirlpool Corporation, Benton Harbor, Mich.

[21] Appl. No.: 945,303

[22] Filed: Sep. 15, 1992

Related U.S. Application Data

[63] Continuation-in-part of Ser. No. 840,027, Feb. 24, 1992, Pat. No. 5,160,094.

[51] Int. Cl.[5] ..... F25C 1/04

[52] U.S. Cl. ..... 62/137; 62/353

[58] Field of Search ..... 62/137, 351, 353

[56] References Cited

U.S. PATENT DOCUMENTS 3,397,553 8/1968 Crowe et al. ..... 62/353
4,665,708 5/1987 Tate, Jr. et al. ..... 62/66
4,800,731 1/1989 Cole ..... 62/233
4,838,026 6/1989 Searl ..... 62/137

*Primary Examiner*—William E. Tapolcai
*Attorney, Agent, or Firm*—Thomas J. Roth; Stephen D. Krefman; Thomas E. Turcotte

[57] ABSTRACT

An ice making apparatus includes a mold in which water is frozen to form an ice body. Also included are an electric motor and an ejector blade for ejecting the ice body from the mold. An ice body collecting bin located subjacent the ice making apparatus collects ice ejected from the mold. A sensing or bail arm extends downwardly into the collecting bin to sense the level of the ice bodies in the bin. The sensing arm is pivotally mounted to the ice maker, and includes a free end which is supported by a spacer mounted to the ice maker. The spacer positions the free end away from the path between the mold and the bin, thereby preventing blockage of ice bodies by the free end. The ice maker includes structure for suspending operation of the ice maker in the event that the sensing arm is obstructed.

3 Claims, 4 Drawing Sheets

FILL CUP SLEEVE FOR A RECOVERABLE DOMESTIC ICEMAKER

RELATED PATENT APPLICATIONS

The present patent application is a continuation-in-part of presently copending U.S. patent application Ser. No. 07/840,027, filed Feb. 24, 1992, now U.S. Pat. No. 5,160,094.

BACKGROUND OF THE INVENTION

1. Field of the Invention

This invention relates generally to ice makers and, more particularly, to an improved ice maker for use in domestic refrigerators and the like including a fail-safe mode of operation.

2. Description of Background Art

In one form of an ice maker, an ice mold and associated mechanism are mounted in the freezer compartment of a domestic refrigerator/freezer apparatus. One example of such an ice maker is illustrated in Chesnut et al., U.S. Pat. No. 4,756,165, which is owned by the assignee of the present invention. Such an ice maker includes a mold in which water is frozen to form an ice body. Also included are an electric motor and an ejector blade for ejecting the ice body from the mold. An electric heater is in heat transfer association with the mold operable to free the ice bodies from the mold prior to the operation of the ejector blade to eject the ice bodies. A control circuit includes a thermostat responsive to the temperature of water in the mold. A thermostat switch is controlled by the thermostat to initiate operation of the motor for ejecting the ice body upon complete freezing thereof and concurrently energizing the heater. An electric circuit means includes the thermostat switch, the motor and a second switch controlled by the operation of the motor for maintaining energization of the motor independently of the first switch and causing the thermostat switch to control further energization of the heater whereby the thermostat switch de-energizes the heater within a single revolution of the ejecting means.

During normal operation of the ice maker described in the '165 patent, a bail arm is provided for sensing the amount of ice collected in a subjacent collection bin. The bail arm can be used as by raising the same to disable operation of the ice maker prior to a harvesting cycle. During a harvesting cycle, the bail arm is automatically raised in order to sense amount of ice in the bin. If insufficient ice is contained in the bin, then during the harvesting cycle the bail arm will be lowered to allow for completion of the harvest cycle and commencement of a subsequent ice making operation.

Occasionally, obstructions may exist in the freezer compartment which prevent the bail arm from lifting. In the ice maker described in the Chesnut et al. '165 patent the motor drives the ejector blade via a shaft having a cam. The cam operates a lever arm which is operable to lift the bail arm. In the presence of an obstruction, the motor will continue rotation possibly resulting in breakage of the lever arm. Alternatively, the lever arm used on the ice maker disclosed therein is designed to be flexible so that the torque produced by the motor causes bowing of the lever arm to bypass the cam so that the harvesting operation continues. Particularly, the lever arm includes a cam follower actuated by the cam which is designed to bypass the cam under an excessive torque condition. Consequently, upon completion of the harvesting cycle, a subsequent ice making operation will begin. Assuming that the obstruction is not removed, then an overproduction of ice can result because the bail arm is obstructed from sensing a full ice bin condition.

In the design of ice makers it is also desirable that ice being ejected from the mold be ejected into the collecting bin, rather than allowing the ice bodies to fall behind the mold. Also, it is desirable to minimize underproduction failures, such as ice bodies pinched between the ejector and stripper or bail arm and support housing.

The disclosed invention is intended to solve one or more of the problems discussed above in a novel and simple manner.

SUMMARY OF THE INVENTION

In accordance with the present invention, an ice maker is provided which is operable to include a fail-safe mode of operation in response to an obstruction to the bail arm.

Particularly, an ice maker is provided which is recoverable in the event an obstruction, such as an obstruction to the bail arm, is encountered. More particularly, the ice maker is operable to fully recover to normal operation without damage to the ice maker or overproduction of ice making subsequent to removal of the obstruction.

Broadly, there is disclosed herein an ice making apparatus including a mold in which water is frozen to form an ice body. Also included are an electric motor and means for ejecting the ice body from the mold. An electric heater is in heat transfer association with the mold operable to free the ice bodies from the mold prior to the ejecting means ejecting the ice bodies. A control circuit includes a thermostat responsive to temperature of water in the mold. A thermostat switch is controlled by the thermostat to initiate operation of the motor for ejecting the ice body upon complete freezing thereof and concurrently energizing the heater. An electric circuit means includes the thermostat switch, the motor and a second switch controlled by the operation of the motor for maintaining energization of the motor independently of the first switch and causing the thermostat switch to control further energization of the heater whereby the thermostat switch de-energizes the heater within a single revolution of the ejecting means. The motor also drives a cam and cam follower for controlling a sensing means for sensing a full ice condition. The ice maker includes structure for suspending operation of the ice maker in the event that the sensing means is obstructed.

It is a feature of the invention that the motor comprises a low torque motor to reduce stress within ice maker components.

It is another feature of the invention that the lever arm includes a cam follower of sufficient strength to prevent breakage and reduce bowing under high stress conditions.

It is a further feature of the invention that the cam follower includes a tip radius engaging the cam to maximize stall characteristics of the assembly and advance the stall position of the ejecting means relative to the cam position so that ice bodies are farther out of the mold.

In accordance with another aspect of the invention, the ice maker is controlled to operate in a normal harvesting mode of operation upon complete freezing of the ice bodies therein an electric heater in heat transfer association with a mold is energized to free ice bodies from the mold. Simultaneously, a motor is started for beginning operation of an ejector blade for removing released ice bodies from the mold. The combination of force generated on the ice bodies plus the heat for releasing the ice bodies from the mold causes the ice bodies to be released and ejected outwardly from the mold. Prior to completion of a harvesting cycle, the control senses the quantity of ice previously harvested and is operable to prevent commencement of a subsequent ice making operation in response to sensing a full condition. In accordance with the invention, the ice maker is further provided with a fail-safe mode of operation which suspends operation of the harvesting cycle in the event that the sensing means is obstructed so that it cannot sense the ice quantity condition.

It is a feature of the invention that the sensing arm is supported in such a manner that, upon release of ice bodies from the mold and ejection outwardly therefrom, the ice bodies are prevented from being trapped by the end of the sensing arm.

It is a feature of the invention that the fail-safe mode of operation terminates upon removal of an obstruction from the sensing arm and the ice maker is configured to automatically recover and return to the normal harvest cycle at the point that harvesting was suspended.

Further features and advantages of the invention will readily be apparent from the specification and from the drawings.

DESCRIPTION OF THE INVENTION

Figure 1:
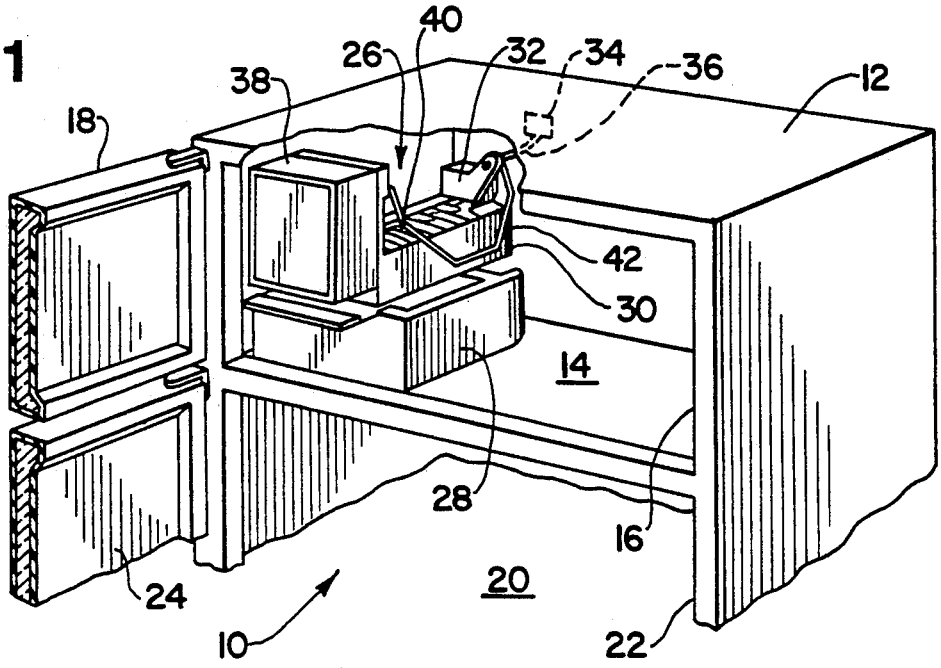
FIG. 1 is a fragmentary perspective view of a refrigeration apparatus having an ice maker embodying the invention.

In the disclosed embodiment of the invention, as illustrated in FIGS. 1–10, a refrigeration apparatus 10 includes an insulated cabinet 12 defining a freezing chamber 14 having a front opening 16 selectively closed by a door 18. The cabinet 12 further includes a fresh food chamber 20 having a front opening 22 selectively closed by a second door 24. An ice maker 26 is disposed within the freezing chamber 14 for forming ice bodies and delivering them to a subjacent collecting bin 28 also disposed within the freezing compartment 14. The compartments 14 and 20 are refrigerated by a suitable evaporator (not shown) disposed within the walls of the cabinet 12. The evaporator forms a portion of a conventional refrigeration including connected components such as a compressor, condenser, capillary and conduit (not shown) for delivering the refrigerant to and from the evaporator.

The ice maker 26 includes a mold 30 in which ice bodies are formed, water being delivered to the mold 30 by a fill cup 32 fluidically connected to a solenoid operated valve 34 by delivery tube 36. The solenoid valve 34 may be connected to a suitable source of water under pressure (not shown). The ice maker 26 further includes a control 38 disposed at the front end of the mold 30 and arranged to operate an ejector blade 40 which upon completion of the freezing of the ice bodies in the mold 30 removes the ice bodies from the mold 30. Particularly, the ejector blade 40 rotates to carry a released ice body out of the mold 30. The ice body is stripped by a stripper 41 and then drops to the subjacent collecting bin 28. A pivotally mounted sensing or bail arm 42 extends downwardly above the collecting bin 28 to sense the level of ice bodies in the bin 28.

MOLD

Figures 2, 3:
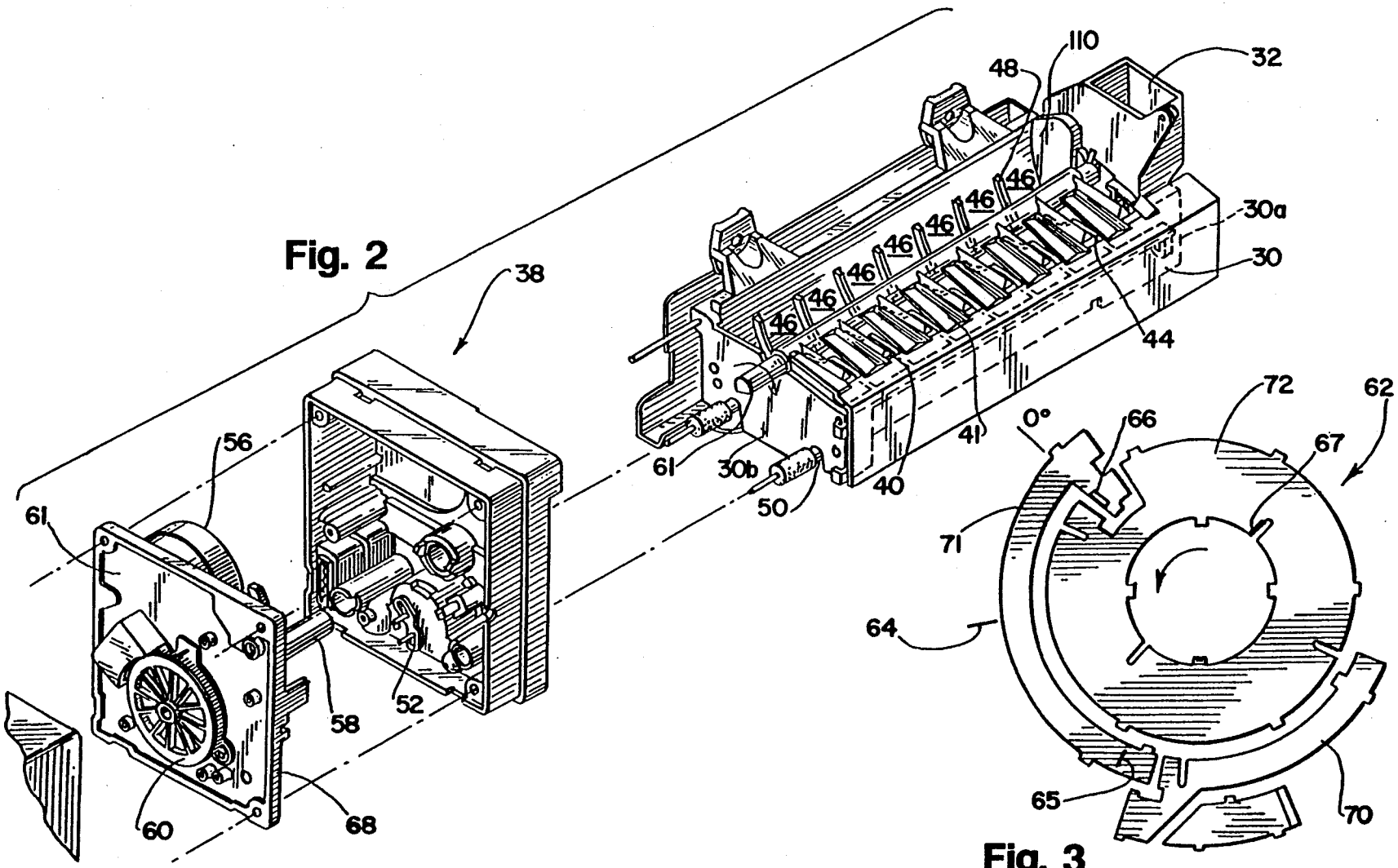
FIG. 2 is an exploded perspective view of a portion of the ice maker of FIG. 1.
FIG. 3 is a circuit diagram of a face cam forming part of the control of the ice maker.

With reference to FIG. 2, the mold 30 is shown to comprise a tray structure having a plurality of partition walls 44 extending transversely across the mold 30 to define a plurality of cavities 46 in which a corresponding plurality of ice bodies are formed. The partition walls 44 are provided with recess portions 48 defining weirs between the respective cavities 46 to permit water to flow from cavity to cavity during the filling operation.

The removal of ice bodies from the mold cavities 46 is facilitated by means of a resistance heater element 50 extending through the mold 30 on the underside thereof. The heater 50 warms the mold sufficiently to melt the surface of the ice bodies engaging the walls of the mold cavities and thereby free the ice bodies for ejection from the cavities by the ejector blade 40.

The mold 30 is manufactured of a light weight aluminum to permit faster heat transfer. Accordingly, ice bodies may be harvested at a greater frequency.

CONTROL

With particular reference to FIGS. 2–5, the control 38 includes a thermostat 52 in heat transfer association with the mold 30 at the one end **30*b* thereof. The thermostat 52 comprises a bi-metal device including a switch 53 having a movable contact 54 and a fixed contact 55. The bi-metal of the thermostat 52 is operable to move the movable contact 54 in electrical contact with the fixed contact 55 when the sensed temperature of the mold is below about 17° F., and to reset at a low temperature, by breaking contact between the movable contact 54 and fixed contact 55**, on the order of 32° F.

Figure 4:
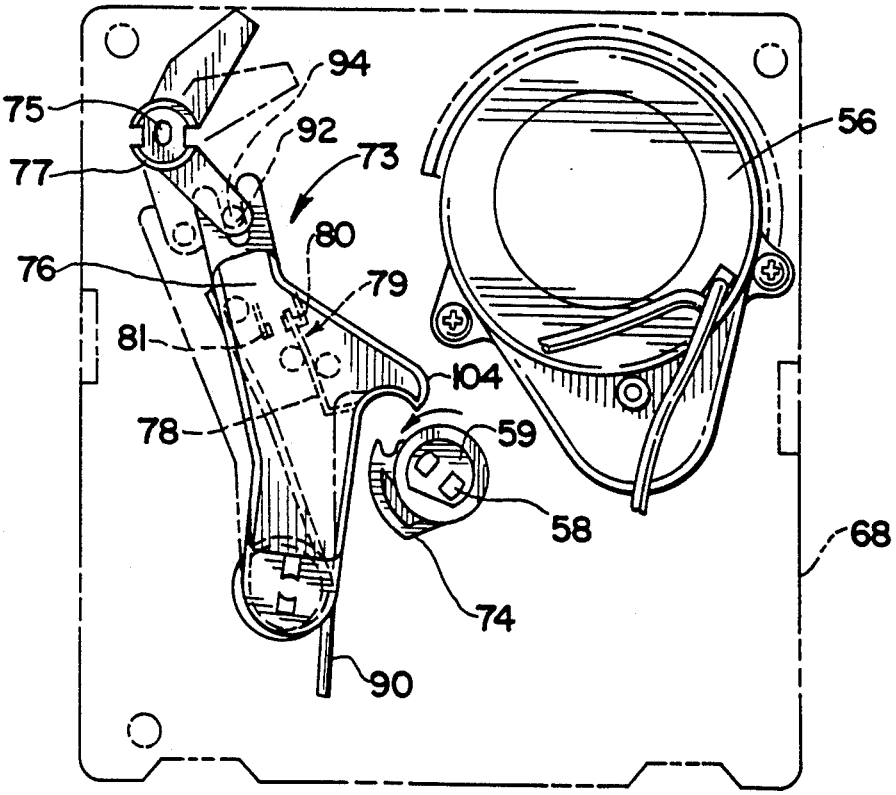
FIG. 4 is an enlarged partial perspective view of another portion of the control of the ice maker.

The control 38 further includes a motor 56 which drives the periphery of a gear 60 on the front side 61 of a base plate 68. The gear 60 is connected to a vertical cam 58 on an opposite side of the base plate 68, as shown in FIG. 4. The vertical cam 58 includes a D-shaped central opening 59 receiving a shaft 61 of the ejector blade 40 for rotation thereof. A rear surface of the gear 60 carries a face cam circuit 62 illustrated in FIG. 3. The face cam circuit 62 comprises bands of electrically conductive material adhered to the rear face of the gear 60. The face cam circuit 62 is illustrated in the at-rest rotational position with the zero degree home position indicated in the upper left-hand corner. Fixed contacts 64–67 comprise electrically conductive face brushes, retained by a base plate 68, in fixed axial and radial positions relative to the cam circuit 62. A first circuit path 70 of the face cam circuit 62 comprises a movable contact in radial alignment with fixed contacts 64 and 65 defining a water valve switch 69. Similarly, a second circuit path 71 comprises a movable contact in radial alignment with fixed contacts 65 and 66 defining a holding switch 73, and a third circuit path 72 comprises a movable contact in radial alignment with fixed contacts 66 and 67 also part of the holding switch 73.

With particular reference to FIG. 4, a cam surface 74 rotationally secured to the cam 58 and axially associated with the face cam circuit 62 cooperates with a linkage mechanism 73 for controllably positioning the sensing arm 42. The linkage mechanism 73 comprises a lever arm 76 and an actuator 77, both pivotally mounted to the base plate 68. The sensing arm 42 is received in an aperture 75 of the actuator 77 and is pivotal therewith. The lever arm 76 is pivotally biased by a spring 90 towards the cam 58. The lever arm 76 includes a forked end 92 surrounding a pin 94 on the actuator 77. Thus, counter-clockwise pivotal movement of the lever arm is converted to clockwise pivotal movement of the actuator 77, and vice-versa. The lever arm 76 further engages a movable contact 78 of a shut-off switch 79 having fixed contacts 80 and 81. The lever arm 76 is biased so that the switch 79 normally engages its moving contact 78 with the fixed contact 80 when the control 38 is arranged, as shown in solid lines in FIG. 4. When the lever arm 76 is pivoted, as shown in dashed line in FIG. 4, either by the cam 58 during a harvest cycle, or by the sensing arm 42 to disable the ice maker 26, the movable contact 78 is in electrical contact with the fixed contact 81.

The general structure of the ice maker described in Chesnut et al., U.S. Pat. No. 4,756,165, the specification of which is hereby incorporated by reference herein, is generally similar to that described herein above. With such an ice maker disclosed therein, the position at which the lever arm 76 is controlled by the cam surface 74 to lift the sensing arm 42 is done at a rotational position of the cam 58 in which the ejector blades 40 have not completely removed ice bodies form the mold 30. If an obstruction exists preventing the lifting of the sensing arm 42, the lever arm, referred to as a "shut-off plate" therein, could break or be bowed sufficiently by coaction between the shut-off plate and cam 74 to effectively bypass operation of the lever arm 76 due to the high torque provided by the motor used therein. In accordance with the invention, the structural details of the motor 56, cam 58 and lever arm 76 are modified so that obstructions which prevent the sensing arm 42 from lifting do not result in cam follower bypass or ice maker overproduction.

Particularly, and with reference to FIG. 4, the D-shaped journal opening 59 in the cam 58 is reoriented approximately 16° relative to that disclosed in U.S. Pat. No. 4,756,165 incorporated by reference herein, so that at a position at which the lever arm 76 is actuated by the cam surface 74 to raise the sensing arm 42, the ejector blade 40 has completely removed ice from the mold 30.

Also in accordance with the invention, the motor 56 is selected to be a lower torque motor than that used in connection with the ice maker disclosed in U.S. Pat. No. 4,756,165. Particularly, the ice maker used therein comprised a model M004 Mallory motor. The motor 56 used herein comprises a M008 Mallory motor which reduces motor torque by fifty percent and reduces corresponding stresses. Such a motor is low torque impedance protected to stall more readily under stall conditions.

Figure 6:
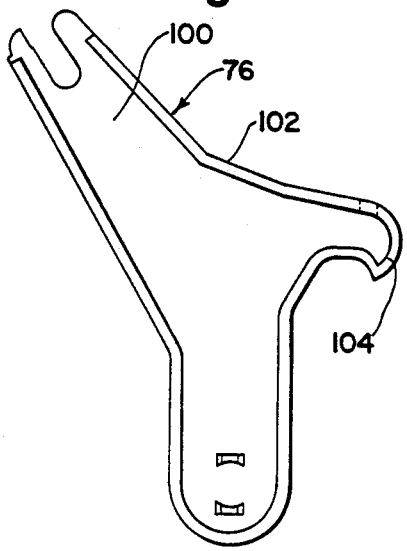
FIG. 6 is an enlarged perspective view of a lever arm forming part of the control portion shown in FIG. 4.
Figure 7:
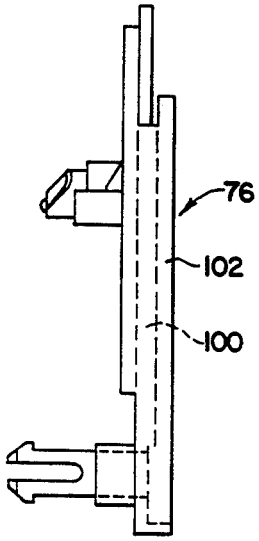
FIG. 7 is a side view of the lever arm of FIG. 6.
Figure 8:
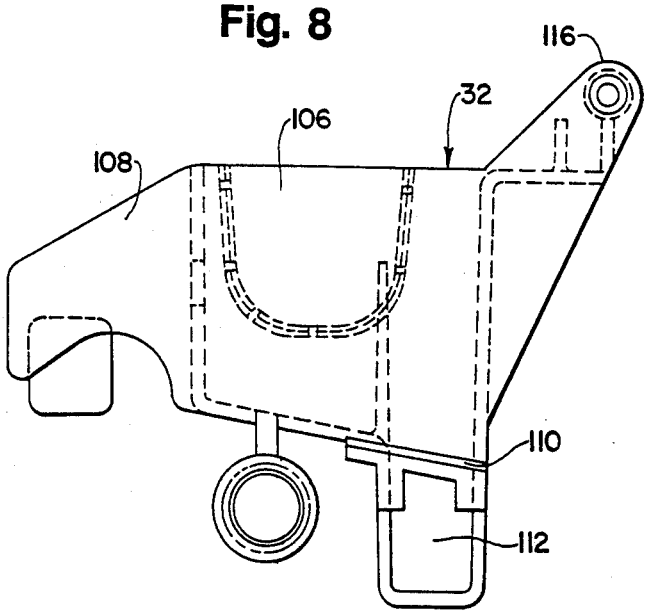
FIG. 8 is a perspective view illustrating a fill cup forming part of the ice maker.

The lever arm 76 is shown in greater detail in FIGS. 6 and 7. In the prior Chesnut U.S. Pat. No. 4,756,165, the lever arm was essentially a flat plastic piece molded to the suitable configuration shown therein. In accordance with the invention, the lever arm 76 is strengthened as by including a central planar plate 100 peripherally surrounded by a flange wall 102 extending on both sides of the plate 100 about most of the periphery of the plate 100. The wall 102 in connection with the plate 100 forms a type of I-beam construction to provide rigidity and prevent bowing.

Additionally, the lever arm 76 is provided with a cam follower tip 104 having a radius to maximize stall characteristics and advance the stall position of the ejector blade 40 so that the ice is still further out of the mold. Particularly, in the U.S. Pat. No. 4,756,165, the lever arm included a cam follower portion having a linear surface which would ride up the cam. The cam follower 104 herein is positioned slightly further from the cam surface 74 to retard the point at which the lever arm 76 starts to pivot to raise the sensing arm 42. This provides extra rotation of the ejector blades 40 out of the mold 30. Further, the use of the radial tip in conjunction with the radial structure of the cam 58 provides a more positive coaction to prevent further rotation of the cam 58 in the event that the sensing arm 42 is obstructed so that the motor 56 stalls more easily.

FILL CUP

The mold 30 includes a rear wall **30*a* to which the fill cup 32 is mounted as shown in FIG. 2. In the U.S. Pat. No. 4,756,165, the fill cup did not extend the full width of the mold 30. In the event that the fill cup is rocked forwardly, ice bodies being ejected form the mold 30 could catch on a square back edge thereof and fall over the back of the mold. In accordance with the invention, and with reference also to FIGS. 8 and 9, the fill cup 32 is provided with a forward wall 106 including an ice body guide 108 so that the fill cup extends the full width of the open upper portion of the mold 30, as shown in FIG. 2. Particularly, the ice body guide 108 fits over a wing portion 110 of the mold 30. This increases the effective height of the rear wall of the mold 30** to prevent ice bodies from falling to the rear of the mold.

Underproduction can also occur if ice bodies are pinched between the various structure provided with the ice maker. In the U.S. Pat. No. 4,756,165, the fill cup included an outlet to the mold in which ice bodies being forced out by the ejector blade could catch. In accordance with the invention, the fill cup is provided with a generally horizontal wall 110 above the outlet 112, see FIG. 8, to provide a raised surface on which ice bodies could ride along and then fall to the stripper 41 to prevent jam-up.

Figure 9:
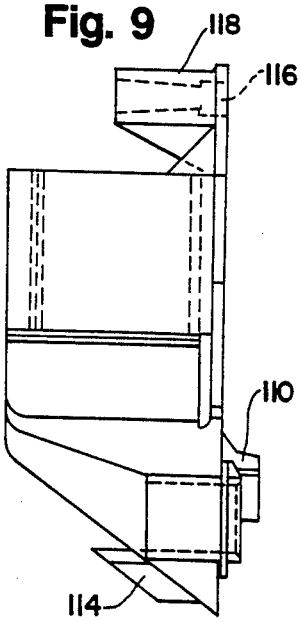
FIG. 9 is a side view of the fill cup of FIG. 8.

An additional change with the fill cup 32 is the addition of a T-shaped projection 114 behind the outlet 112, see FIG. 9, to prevent wicking of water over the back of the mold 30.

Additionally, the fill cup 32 includes an opening 116 for pivotally mounting the sensing arm 42. A rearwardly extending spacer 118, see FIG. 9, is provided to support the sensing arm 42. The spacer 118 holds the sensing arm 42 back to prevent jams during the harvesting cycle.

Spacer 118 also prevents the end of sensing arm 42 from extending through opening 116, thereby providing a substantially flat front surface of fill cup 32 against which ejected ice bodies may pass unobstructed. Advantageously, spacer 118 extends between 5.60 mm and 8.93 mm from fill cup 32.

OPERATION

Figure 5:
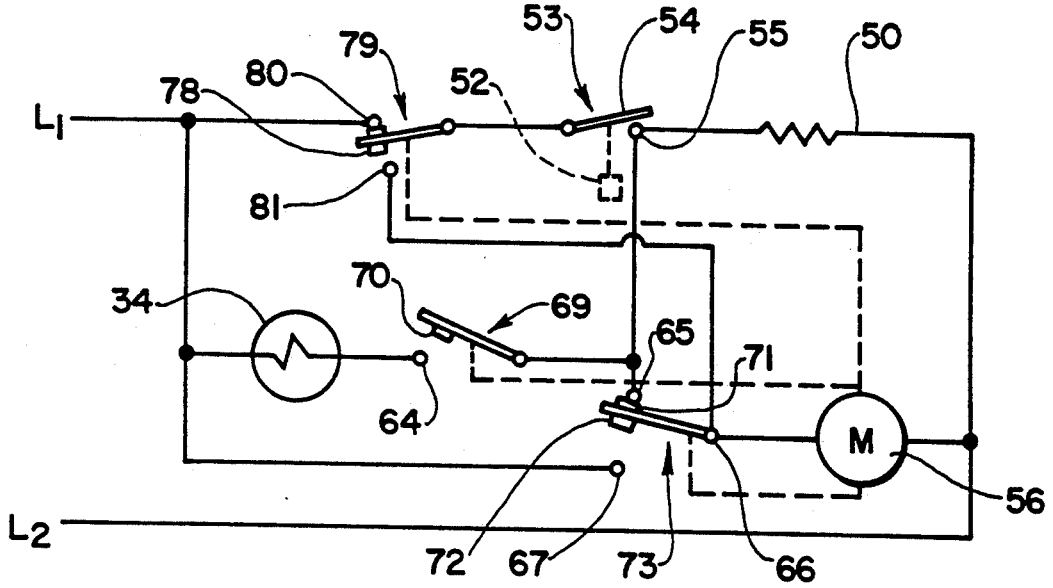
FIG. 5 is a schematic electrical wiring diagram illustrating the circuitry of the ice maker.

The operation of the control 38 is as follows. Assuming that the mold contains a quantity of water in the process of being frozen to form the ice bodies in the cavities 46 and the level of the ice bodies in collecting bin 28 is below the preselected full level, the mold thermostat 52 senses a relatively warm condition whereby the switch 53 is in the open condition, as shown in FIG. 5. Further, the shut-off switch 79 has movable contact 78 in contact with fixed contact 80, the holding switch 73 has the movable contact 71 thereof in contact with the fixed contact 65 and the water valve switch 69 has its movable contact 70 spaced from its fixed contact 64. Thus, the control 38 is in a de-energized condition between power supply leads L1 and L2.

As described above, the thermostat 52 is arranged to have a cut-in temperature of about 17° F. and a reset or cut-out temperature of 32° F. Thus, when the water in the mold cavity 46 becomes completely frozen and the temperature thereof drops to 17° F., the thermostat switch 53 is operated to close contact 54 with contact 55, thereby establishing a circuit from power supply lead L1 through contact 80 and 78 of switch 79, contacts 54 and 55 of switch 53, and through the heater 50 to lead L2. At the same time, the control motor 56 is energized from contact 55 through contacts 65 and 71 of the holding switch 73. This causes the gear 60 to rotate from the zero degree rest position illustrated for the face cam circuit 62 in FIG. 3 and for the ejector blade 40 to rotate from its zero degree rest position illustrated in FIG. 10. The cam face circuit 62 of FIG. 3 is accordingly rotated in a counter-clockwise direction, whereupon, after a few degrees of rotation, the second cam surface path 71 breaks contacts between fixed contact 65 and 66, and the third cam surface path 72 makes contact between fixed contacts 66 and 67 thereby establishing a holding circuit from lead L1, through contacts 67 and 66 to motor 56 whereby the motor 56 is energized regardless of the condition of the thermostat switch 53.

The operation of the motor 56 causes rotation of the shaft 58 until the ejector blade 40 engages the ice bodies I within the mold cavity 46 at approximately 54° of rotation. In the event the ice bodies have not been freed from the mold walls, the motor 56 stalls until such time as the mold heater 50 melts the ice bodies free. The motor then continues rotation of the ejector blade 40, to move the ice bodies from the cavities 46.

Beginning at approximately 180° rotation of the shaft 58 the cam surface 74 causes the lever arm 76 to pivot in a counter-clockwise direction, see FIG. 4, thereby pivoting the actuator 77 clockwise and thus raising the sensing arm 42 upwardly from the collecting bin 28. At the same time, the lever arm 76 breaks contact between moving contact 78 and the fixed contact 80 and after a suitable dead-zone makes an electrical contact between the movable contact 78 and the fixed contact 81. This establishes a circuit to the heater 50 from lead L1 through contacts 67 and 66 of the holding switch 73, contacts 81 and 78 of the shut-off switch 79 and contacts 54 and 55 of the thermostat switch 53. Thus, the control motor 56 is energized independently of the thermostat switch 53, while the heater 50 is energized under the control of the thermostat switch 53.

Between approximately 135° and 180° rotation of the ejector blade 40 the heater 50 will have heated the mold up sufficiently, i.e. 32° F., to reset the thermostat 52 and accordingly open the switch 53 by moving the movable contact 54 thereof away from the fixed contact 55, thus de-energizing the heater 50. This results in the heater 50 being de-energized while the ice bodies are still partially within or just removed from the mold 30. The mold 30 continues to heat up slightly due to heat dissipation from the heater 50, preventing the ice bodies from again freezing to the mold 30. However, the temperature of the mold should not exceed 40° F. As the holding switch 73 is arranged with fixed contacts 66 and 67 electrically connected, the control motor 56 continues to operate.

At approximately 288° of rotation, the first face cam path 70 completes an electrical contact between fixed contacts 64 and 65 of water valve switch 69. Since switch 53 is now open, the solenoid 34 becomes energized to admit water through the inlet 32 to the mold cavity 46 for forming a subsequent group of ice bodies in mold 30. After a preselected period, for example, at 303° rotation, the water valve switch 69 opens by the first face cam surface path 70 breaking contact between fixed contacts 64 and 65, thereby terminating the flow of water to the mold cavities 46. In the event that the thermostat switch 53 remains closed, then the solenoid 34 is short circuited to prevent a filing operation. This will typically result, for example, if ice bodies remained in the mold 30, a condition in which it would be undesirable to add additional water. This could happen, for example, if the ejector blade 40 broke so that the ice bodies were not ejected from the mold 30.

At approximately 335° rotational position of the ejector blade 40, the lever arm 76 is pivoted by the cam 58 to lower the sensing arm 42 into the collecting bin 28. If the level of ice bodies collected in the bin 28 is below a preselected level, then the sensing arm 42 moves downwardly into the bin 28 and allows the lever arm 76 to pivot sufficiently to permit the movable contact 78 to become repositioned, as shown in FIG. 4, with the movable contact 78 spaced from the fixed contact 81 and now engaging the fixed contact 80.

The completion of the control cycle occurs upon a small additional operation of the motor 56 whereby the third cam surface path 72 breaks contact between the fixed contacts 66 and 67 to open the holding switch 73. The control 38 is now fully de-energized at the beginning of the operation cycle as discussed above, whereby a subsequent cycle will become initiated by the complete freezing of the ice bodies in the mold as discussed above.

When a sufficient number of ice bodies have been delivered to the collecting bin 28 so as to cause the level therein to rise to a preselected full level, the operation of the control 38 as discussed above will be interrupted by preventing the lever arm 76 from returning to the normal position shown in solid line in FIG. 4. Thus, the movable contact 78 remains in engagement with the fixed contact 81 and the circuit remains broken between the contacts 78 and 80. This condition will remain until such time as the level of ice bodies in the bin is lowered as by removing some or all of the ice bodies therein. When this occurs, the release of the sensing arm 42 permits the return of lever arm 76 to the position of FIG. 4, thereby allowing the switch 79 to close movable contact 78 with fixed contact 80 and permitting subsequent operation of the control 38, as discussed above. It should be noted that this termination of operation of control 38 may occur during the rotation of the cam 58 and the operation of control 38.

Thus, the control 38 utilizes a single thermostat 52 to control both the mold heater 50 and the control motor 56. The control 38 is arranged to prevent overheating by the mold heater 50 such as might occur if the control motors 56 or the holding switch 73 fails or the ejector blade 40 becomes jammed, such as by interferences with the mold walls. Moreover, by utilizing a thermostat having a narrow operating range, the temperature of the mold will be generally maintained near the upper and lower limits of the thermostat, herein 32° F. and 17° F., respectively, and the ice maker is operable to complete a cycle during a single revolution of the ejector blade 40.

The provision of a single revolution ice maker, with the control de-energizing the heater shortly after the ice bodies are freed from the mold, enables the ice maker embodying the invention to harvest a minimum of one additional batch per day. Also, less energy is required to product the ice, resulting in decreased energy costs.

The ice maker 26 according to the invention as described above normally operates in one of three modes of operation. If the sensing arm 42 is raised, then the ice maker 26 is effectively disabled or turned off. Another mode of operation comprises the normal freeze cycle during which water contained in the mold 30 is being frozen. Upon completion of the freezing cycle, as sensed by the thermostat 52 as discussed above, a harvest cycle or mode begins. The harvest cycle is used to remove the ice bodies from the mold 30 and drop them into the collecting bin 28. In accordance with the invention, a fail-safe mode of operation is added in which the harvest cycle is suspended when an obstruction is present and the fail-safe mode of operation includes provisions for recovering without damage or overproduction once an obstruction is removed.

Figure 10:
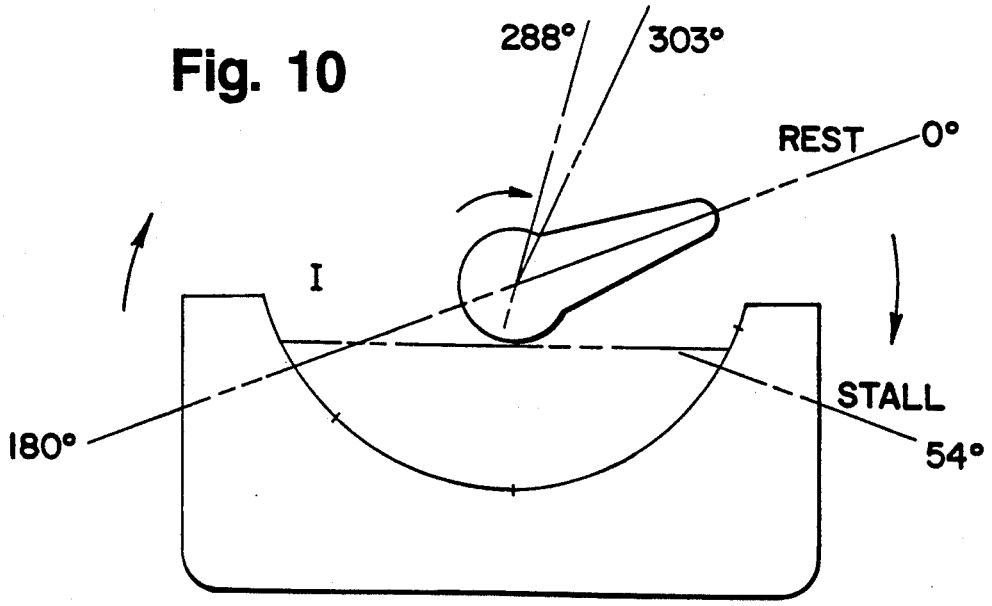
FIG. 10 is a graphical illustration showing various rotational positions of the ejector blade relative to positions of the face cam of FIG. 3.

Particularly, at the 180° rotational position discussed above, the lever arm 76 is driven by the cam 58 to raise the sensing arm 42. If the sensing arm is obstructed, then it will be prevented from raising. With the prior ice maker design disclosed in U.S. Pat. No. 4,756,165, this condition could result in damage to the lever arm or flexing of the lever arm so that the cam follower is effectively bypassed, possibly resulting in overproduction of ice. In accordance with the invention, if an obstruction prevents lifting of the sensing arm 42, then this obstruction prevents rotation of the actuator 77 thereby preventing rotation of the lever arm 76. This produces a force coacting between the radial tip of the cam follower 104 and the cam surface 74 to prevent further rotation of the cam 58. Because the motor 56 is provided to have low torque impedance protection, the motor 56 immediately stalls to suspend operation of the ice maker 26. During this time, the status of the shut-off switch will depend on the degree of obstruction. If the shut-off switch movable contact remains in contact with the fixed contact 80, then the heater 50 will cycle as controlled by the thermostat 52. If the movable contact 78 is positioned intermediate the fixed contact 80 and 81, then the heater will remain off. In any event, the motor being stalled will prevent any further rotation of the cam 58 and thus ejector blade 40 so that operation is effectively suspended. However, because the ejector blade is at least at the 180° rotational position as shown in FIG. 10, the ice bodies are fully removed from further contact with the mold s that the ice bodies will not freeze back onto the mold.

Subsequently, when the obstruction is removed, the motor 56 is still energized and thus immediately recovers to normal operation. Because the ice bodies are fully removed from the mold 30, the ejector blades 40 are free to rotate and thus continue and finish the normal harvest cycle of operation.

Thus, in accordance with the invention, a cycle for an ice maker is provided which is fail-safe as by preventing to components or overproduction of ice during the existence of obstructions to operation. Furthermore, the system recovers immediately upon removal of the obstruction without damage to components, without the need for a service call for repair, and without the undesirable overproduction which could otherwise result.

Thus, the invention comprehends a spacer extending from the front surface of the fill cup, for preventing obstruction of the ejected ice bodies by the sensing arm end.

We claim:

1. An ice making apparatus comprising:
a mold in which water is frozen to form an ice body;
means for ejecting said ice body from said mold;
an electric motor;
a drive system driven by said motor and operatively driving said ejecting means;
storage means for storing ice bodies ejected from said mold;
said mold and said storage means defining a free path for passage of said ejected ice bodies therebetween;
a sensor arm having a free end, said sensor arm being mounted on said ice making apparatus for sensing a quantity of ice bodies previously ejected by the ice making apparatus and stored in said storage means;
support means for supporting said free end of said sensor arm, said support means including means for preventing extension of said free end of said sensor arm into said path for ejected ice bodies;
said support means for supporting said free end of said sensor arm comprising a fill cup; and
said fill cup having a projection extending therefrom, said projection including a spacer projecting therefrom including an opening for supporting said sensor arm.

2. The ice making apparatus of claim 1, said opening extending through said projection and said spacer.

3. The ice making apparatus of claim 1, said spacer extending between 5.6 mm and 8.93 mm from fill cup.

* * * * *